United States Patent [19]

James

[11] 4,179,947

[45] Dec. 25, 1979

[54] COUNTERBALANCED PUMPING SYSTEM

[76] Inventor: Robert G. James, 3509 Janene Way, Bakersfield, Calif. 93306

[21] Appl. No.: 824,346

[22] Filed: Aug. 15, 1977

[51] Int. Cl.[2] ..... F16H 29/02

[52] U.S. Cl. ..... 74/89.2; 212/93; 254/178; 254/175.5; 187/94; 74/591

[58] Field of Search ..... 254/178, 755; 212/48, 212/93, 100; 200/61.16; 248/364, 329, 331; 16/193, 194; 74/89.21, 89.20, 89.22; 114/200; 417/539; 187/94

[56] References Cited

U.S. PATENT DOCUMENTS

| | | | |
|---|---|---|---|
| 481,011 | 8/1892 | Denton | 254/178 |
| 1,464,294 | 8/1923 | Reese | 254/178 |
| 1,542,808 | 7/1925 | Adams | 200/61.16 |
| 2,627,715 | 2/1953 | Horne | 74/216.5 |
| 2,898,083 | 8/1959 | Kresl | 254/175.5 |
| 3,519,213 | 7/1970 | Hofmann | 200/61.16 |
| 3,672,237 | 6/1972 | Nagin | 74/89.21 |
| 3,793,904 | 2/1974 | Grable | 254/178 |
| 4,062,640 | 12/1977 | Gault | 74/89.22 |

*Primary Examiner*—Samuel Scott
*Assistant Examiner*—G. A. Anderson
*Attorney, Agent, or Firm*—I. Michael Bak-Boychuk

[57] ABSTRACT

An eccentric balancing system for assisting the reciprocal motion of a well pump which includes a first mandrel having wound thereabout a first sheave chain, the wind up of the first sheave chain being arranged for stacked alignment. A second mandrel, mounted for rotation with the first mandrel, is wound in the opposite direction to store in stacked arrangement a second sheave chain which may be either connected to a counter balancing weight or which may be deployed to articulate a second well pump. In the event that the second mandrel is utilized to articulate a second well pump a third mandrel may be utilized for counterbalancing any inequalities between the two well bores. It is intended to include a switching circuit, which according to the playout of the sheave chains engages an electric motor to augment the losses attendant with pumping fluid and the friction losses in each bore.

7 Claims, 5 Drawing Figures

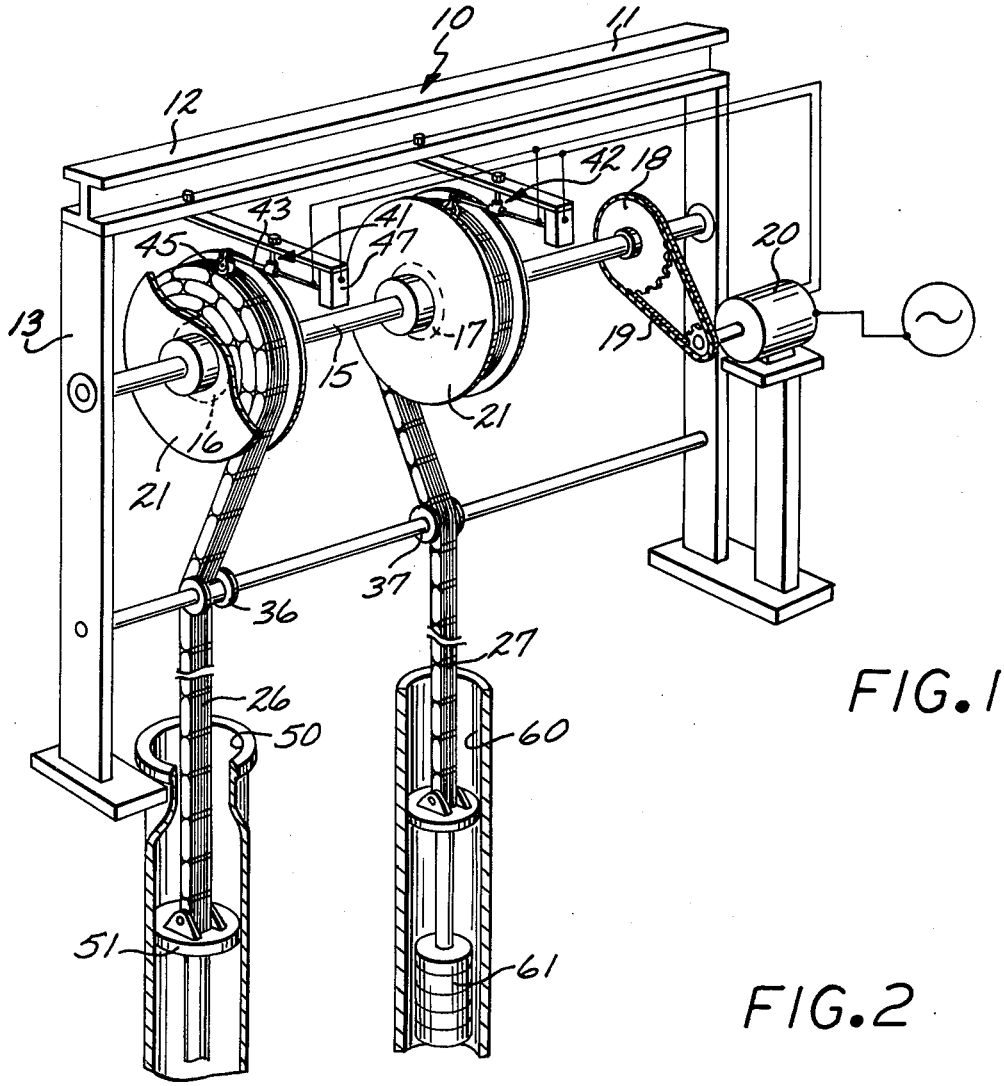
FIG. 1
FIG. 2
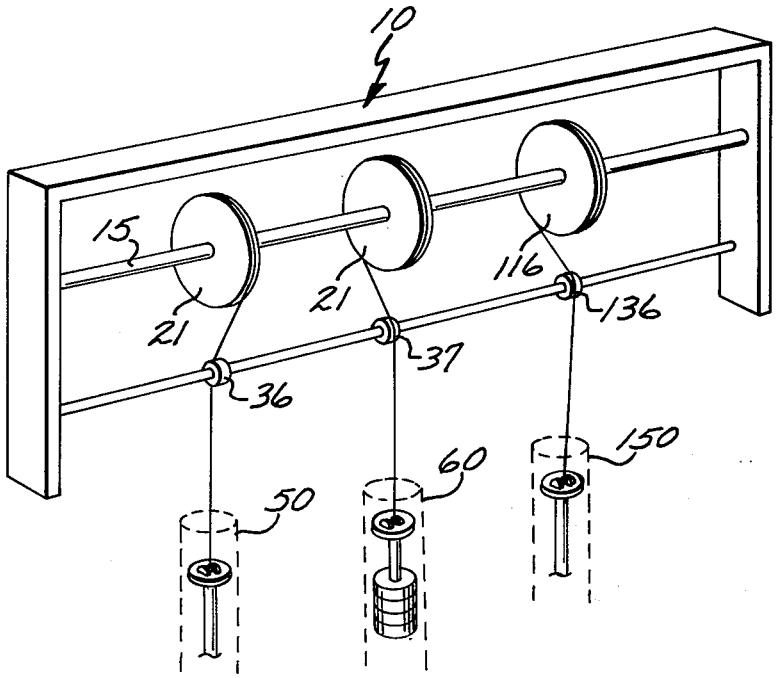

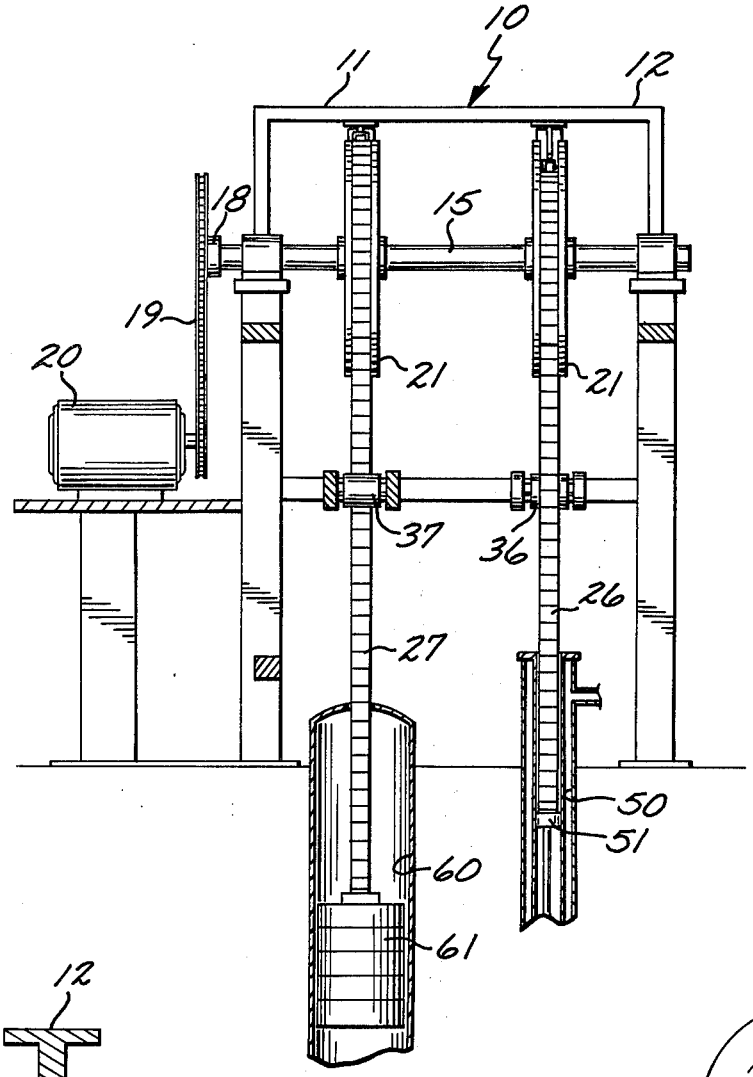
FIG. 3
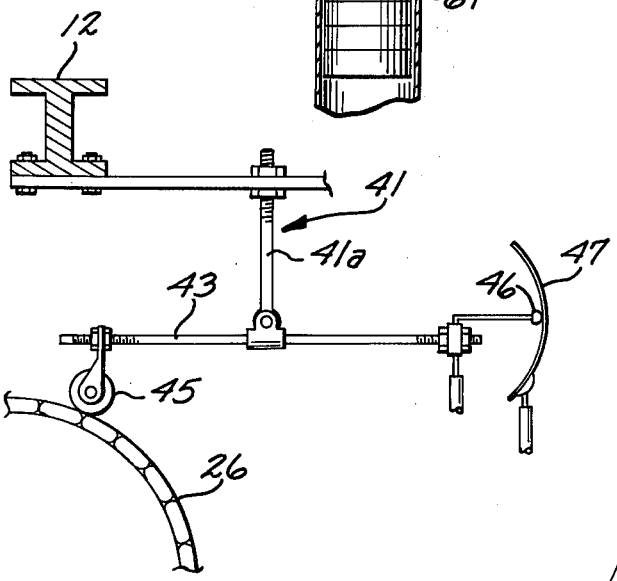
FIG. 5
FIG. 4
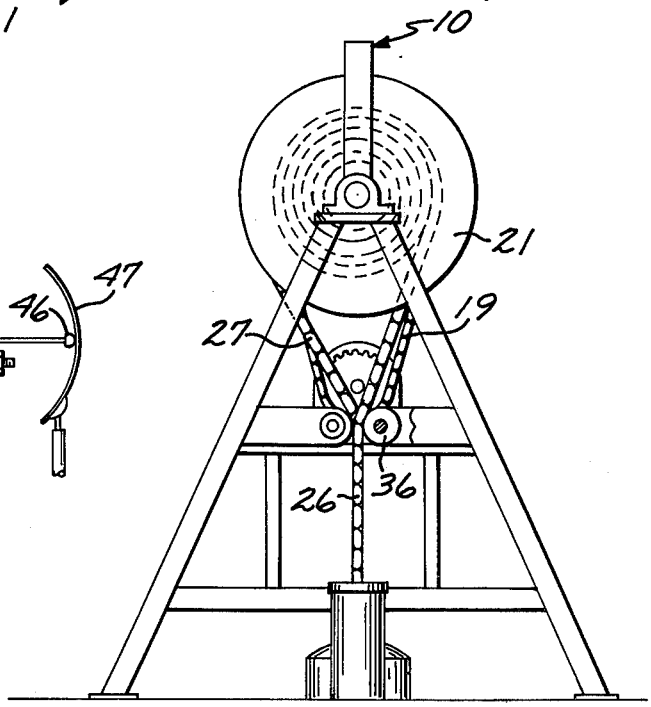

COUNTERBALANCED PUMPING SYSTEM

BACKGROUND OF THE INVENTION

1. Field of the Invention

The present invention relates to deep well pumping devices and more particularly to a counterbalancing arrangement useful therewith.

2. Description of the Prior Art

As the deposits of oil are used up, extraction from less productive fields become an economically feasible operation. Characteristically, drilling in less productive fields is associated with decreases in the efficiency to a point where the extraction process itself quickly dominates the competitive advantage that a particular producer engages in. Heretofore most of the prior art pumping mechanisms attempted to convert from rotary input into a reciprocal input at the well pump. To achieve this various counterbalances were often necessary. Most frequently, the counterbalancing was arranged to augment the operation of a walking beam pumping device. These devices require constant application of power and the power consumption therefore varies over the load variations incident in the pumping stroke. This variation in power input has been recognized as a major cause of inefficienty, the power plant often operating outside of the optimum band as various load peaks are encountered.

In alternative prior art devices the use of electric motor switching has been practiced, and again on each reciprocating cycle a full reversal of motor input is made. This technique encounters the necessary starting transients in each stroke cycle which in the case of electrical power entails large periodic current draws. Similarly, in the case of mechanical motors, the switching arrangement entails complicated clutching and gearing sequences which once more are a source of great power loss.

Thus, in each instance, less than optimum use of the power input is found. In the more recent developments, a device known as the Alpha I, sold by the Bethlehem Steel Corporation, utilizes an eccentrically wound cable system, one eccentric feeding the well pump while the other eccentric being tied to the counter balance. By virtue of this arrangement, an oscillatory system is made out which, in the absence of the pumping and friction losses will maintain oscillations indefinitely. Thus, the only added input is that required to overcome the fluid friction and the pumping heads, i.e., work directly associated with the production of oil. This same Alpha One system, in order to overcome the start-up transient losses set out above, also include switching logic whereby the electric motor is switched on during the times as when the stroke of the pump is at substantial velocity.

The wind up of cable, however, on an eccentric spool requires compound spool arrangements and consequently the angle of departure of the cable varies throughout the stroke. This inherent feature grossly reduces the life expectancy of the cable and furthermore adds friction to the system which must be compensated for by way of external power input. Thus, while the last mentioned pumping apparatus does provide great advantages in power utilization, certain features thereof may be improved for full mechanical optimization.

SUMMARY OF THE INVENTION

Accordingly it is the general purpose and object of the present invention to provide an eccentric arrangement which is achieved by way of stack up of a sheave chain around a mandrel.

Further objects of the invention are to provide a counterbalanced pumping structure which by virtue of its mechanical layout is classically oscillatory.

Yet additional objects of the invention are to provide an eccentrically counterbalanced pumping system wherein a plurality of well pumps may be used in complementing arrangement.

Yet further objects of the invention are to provide a counterbalanced pumping system which is convenient in use, reliable over extended periods of time and simple in manufacture.

Briefly, these and other objects are accomplished within the present invention by combining a plurality of mandrels on a common shaft, where in one arrangement more than one well pump is articulated in complement. In the other arrangement only a single mandrel is required to articulate a well pump, the other mandrel being utilized for supporting a counter balance. Wound around each mandrel, in spiral stack-up, is a sheave chain, which is then directed across corresponding guide rollers to an axial alignment relative the pumping axis or the axis of the counterbalance. It is the use of this sheave chain, and particularly the thickness thereof that provides the necessary moment arm advantage as the chain is taken up. Thus, for example, as one mandrel is taking on chain the radial arm about the common axis increases. The other mandrel, being wound in the opposite direction, concurrently decreases in radius. In this manner a self-limiting arrangement is achieved wherein the increase in moment arm and therefore torque on one mandrel, opposes the momentum of the weight suspended from the other mandrel. The foregoing arrangement thus provides for a classically oscillating system where the only losses are those associated with friction and the work extended in pumping the fluids. Since friction in a sheave chain is known to be minimal, it is only the fluid friction and the possible sucker rod friction within the well bore that provides the major losses to be augmented by a power source. This power input is applied by way of a chain drive, connected to the common axis, which in turn is driven by an electric motor. To accommodate the reversals incident to the reciprocal motion thus set out it is contemplated to provide a frame member over the various mandrels, the frame member adjustably supporting a plurality of switches, each articulated by a lever engaging the exterior rank of the sheave chain. In this manner selection can be made of the point at which power is applied, thus providing a convenient technique for turning on the motor at a point when its angular rate is relatively high. This, once more, reduces the startup current draws typically incident in any motor switching, further increasing the efficiency of the system.

BRIEF DESCRIPTION OF THE DRAWINGS

FIG. 1 is a perspective illustration of a first arrangement of the inventive system disclosed herein;

FIG. 2 is a perspective illustration of a second arrangement of the inventive system adapted for plural pumping;

FIG. 3 is a front view of the system shown in FIG. 1;

FIG. 4 is a side view of the system shown in FIG. 1; and

FIG. 5 is a detail illustration of a switch assembly useful herein.

DESCRIPTION OF THE PREFERRED EMBODIMENT

While the following description is primarily directed to the use of the present device in oil pumping applications, such is exemplary only. It is to be understood that other uses than those set out herein may be achieved by the apparatus disclosed and no intent to limit the scope of the invention thereby is expressed.

As shown in FIGS. 1, 3 and 4 the inventive counterbalanced pumping system, generally designated by the numeral 10, comprises a frame 11 including a horizontal spine member 12 supported at either end by a vertical stand 13 and 14 respectively. Extending below spine member 12 between stands 13 and 14 and supported for rotation therein is a mainshaft 15, shaft 15 being aligned substantially horizontal relative the ground plane. Supported on shaft 15, in spaced relation, is a first and second mandrel 16 and 17 respectively, each mandrel being clamped between two circular side walls commonly designated by the numeral 21. It is within this gap between the adjacent side walls clamping mandrels 16 and 17, that a sheave chain is stored, in the illustration herein, mandrel 16 storing a sheave chain 26 while mandrel 17 storing a length of sheave chain 27.

The thickness of each mandrel 16 or 17 is substantially equal to the width of the corresponding sheave chain, thus providing a gap between side walls 21 in which the chain is spirally stacked. The direction of wind-up of chains 26 and 27 on the respective mandrels is opposite, and when sheave chain 26 is being taken up, sheave chain 27 is being played out. Sheave chains 26 and 27 are each respectively turned about corresponding guide rollers 36 and 37 deployed on shaft 35 aligned below the axis of the mandrels 16 and 17, rollers 36 and 37 providing the necessary angulation of the corresponding chain from the varying angle of departure to a vertical alignment. Thus sheave chain 26, as it departs downwardly from roller 36 is available to extend into a well bore 50, supporting a pumping assembly 51 at the end thereof. Sheave chain 27, on the other hand, extends into a balance pit 60 to support a counterbalance 61 on the interior thereof. Each sheave chain, in turn, is fixed at one end to the corresponding mandrel, the mandrels being keyed or otherwise fixed in rotation on shaft 15.

By selective adjustment of the weight of the counterbalance 61 it is possible to achieve matched condition for a balanced equilibrium with the weight of the well pump 51. Thus a classical oscillatory system is achieved. The dynamics of motion of this system are further enhanced by the non-linear increase in the moment of inertia of the respective mandrels or spools which are taking in the chain. The net effect is to exchange the linear momentum for angular momentum at the upper and lower limits of the pumping stroke. Any power input required is therefore only necessary to overcome the friction losses and the fluid bed incident to the reciprocal pumping set out.

To provide for this power input, and in particular in order to compensate for the work expended in bringing the well fluid up to the surface, shaft 15 is further secured to a driven chain sprocket 18, which by way of a chain drive 19 engages an electric motor 20. Motor 20 may be a conventional split phase reversing motor, receiving power from a conventional AC power source S and being switched in reversal by way of the control connections included therein. The switching inputs achieving the necessary motor reversal are provided by two switches 41 and 42 adjustably suspended from the spine member 11 to extend for articulation by the stored sheave chain on the corresponding mandrels 16 and 17.

While the implementation of switches 41 and 42 may be variously achieved for the purposes herein an arrangement shown in FIG. 5 is exemplary. Shown in this figure is switch 41, it being extended to construct switch 42 in the same manner. Thus switch 41 includes a pivoted lever 43, adjustable in length, terminating in a roller 45 riding on the exterior rank of the stored chain 26. The other end of lever 43 supports an insulated contact 46, connected to one of the control inputs to motor 20, extending to contact an arcuate contact strip 47 completing the circuit.

It is intended to suspend switches 41 and 42 on threaded supports 41(*a*) and 42(*a*) thus providing for manual adjustment of the deployment height of each switch. By virtue of this arrangement the contact arc during which the motor is engaged in either forward or reverse direction can be controlled according to the take-up of the respective sheave chain on the corresponding mandrel.

As shown in FIG. 2 the foregoing implementation may be further expanded to include yet another well pump generally designated by the numeral 150, well pump 150 being in turn, articulated by a sheave chain 126 counterwound from yet another mandrel 116 similarly constructed. It is intended to support mandrel 116 on the common shaft 15, the disposition thereof being determined by the separation between the adjacent well bores. In this configuration the counterbalance 61 and its corresponding mandrel 17 functions to accomodate any balance mismatch between the two pumps. This mismatch may be conveniently adjusted by the size of the weight 61 and the diameter of the mandrel 17.

While the classical relationship of the foregoing assembly is non-linear, certain features thereof may be generally set out. Specifically, as each sheave chain is taken up the angular moment of inertia associated therewith increases non-linearly. Thus, towards the limits of each stroke this increase in angular momentum reduces the vertical momentum of the various pumps. It has been found by experimentation that a stroke-to-mandrel build-up of approximately 2 or 3:1 best achieves the desired stroke efficiency. This ratio can best be achieved by selection of the length of stroke and the thickness of sheave chain selected.

Typically, it has been found that as the depth of the well bore increases the efficient stroke length increases. The depth therefore has an attenuating effect, in that the corresponding sheave build up on the mandrel increases. In this manner chain of conventional size may be utilized for the purpose of practicing the invention, in each instance consideration is being necessary for the weight and angular rate entailed in the motion.

Furthermore, the deployment of the corresponding switches 41 and 42 can be manually adjusted for achieving the necessary motor input during the high rate segments of the reciprocal motion. The motor 20, being directly tied by way of the chain drive 19, is therefore coupled to the angular rate and may be switched in according to the most optimal conditions selected. Once more the convenience of adjusting the switching position and the convenience of selecting the angle over which contact is made, allows for an expedient technique by which the normally present high amperage transients are avoided. The net effect of the foregoing structure is to reduce the power input necessary in extracting oil to the minimal levels entailed in the work necessary to lift the fluid and the fluid friction normally incident in any pumping.

Obviously many modifications and variations to the above disclosure can be made without departing from the spirit of the invention. It is therefore intended that the scope of the invention be determined solely dependent on the claims attached hereto.

What is claimed is:

1. Apparatus for articulating linearly reciprocal devices comprising:

a frame adapted for upright support placement;

a shaft mounted for rotation in said frame in substantially horizontal alignment;

motor means connected to assist in rotation of said shaft;

a first and second substantially circular mandrel secured in spaced relationship on said shaft;

a first sheave chain attached to said first mandrel and spirally wound upon itself in a first direction around the periphery thereof the free end of said first sheave chain being attached to said reciprocal device;

a second sheave chain attached to said second mandrel and spirally wound upon itself in a second direction around the periphery thereof; and counterbalancing means connected to the free end of said second sheave chain, whereby the spiral windup of said first sheave chain is variably opposed by said second sheave chain according to said peripheries thereof to form an oscillary system.

2. Apparatus according to claim 1 further comprising:

a first and second guide roller mounted respectively for rotation in said frame in co-planar alignment relative said first and second mandrel, said first guide roller being disposed to guide said sheave chain to a substantially vertical alignment relative said device and said second roller being disposed to guide said second sheave chain to a substantially vertical alignment relative said counterbalancing means.

3. Apparatus according to claim 2 wherein:

said first and second mandrel each include lateral side plates, the associated ones thereof being separated by a dimension substantially equal to the width of the corresponding one of said first and second sheave chain.

4. Apparatus according to claim 1 wherein said motor means includes:

control means for reversing the direction thereof according to the length of said first or second sheave chain respectively wound around said first or second mandrel.

5. Apparatus according to claim 4 wherein:

said motor means comprises a reversing electric motor; and said control means comprises a pivotal switch adjustably extended to engage the exterior rank of said first or second sheave chain.

6. Apparatus according to claim 5 wherein:

said pivotal switch includes a threaded vertical support member secured to said frame, a pivot adjustably secured to said support member a lever adjustably secured at a preselected point to said pivot, a roller mounted on one end of said lever for rolling engagement of said first or second sheave chain, a first switch terminal connected to the other end of said lever, and a second switch terminal disposed from said frame for contacting said first terminal at a predetermined arc segment in the pivotal motion of said lever.

7. Apparatus according to claim 1 wherein:

said counterbalancing means includes yet another one of said reciprocal devices.

* * * * *